US010641285B2

(12) United States Patent
Tu et al.

(10) Patent No.: US 10,641,285 B2
(45) Date of Patent: May 5, 2020

(54) FAN AND FRAME STRUCTURE THEREOF

(71) Applicant: DELTA ELECTRONICS, INC., Taoyuan (TW)

(72) Inventors: Tai-Ying Tu, Taoyuan (TW); Yi-Wen Lin, Taoyuan (TW); Chih-Hui Wu, Taoyuan (TW); Ming-Kai Hsieh, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 326 days.

(21) Appl. No.: 15/686,530

(22) Filed: Aug. 25, 2017

(65) Prior Publication Data

US 2018/0058470 A1 Mar. 1, 2018

Related U.S. Application Data

(60) Provisional application No. 62/379,415, filed on Aug. 25, 2016.

(30) Foreign Application Priority Data

Jul. 18, 2017 (CN) ..... 2017 1 0585556

(51) Int. Cl.
*F04D 29/52* (2006.01)
*F04D 19/00* (2006.01)
(Continued)

(52) U.S. Cl.
CPC ..... *F04D 29/522* (2013.01); *F04D 19/002* (2013.01); *F04D 25/08* (2013.01); *F04D 29/325* (2013.01); *F04D 29/542* (2013.01)

(58) Field of Classification Search
None
See application file for complete search history.

(56) References Cited

U.S. PATENT DOCUMENTS 6,860,713 B2 * 3/2005 Hoover ..... F01D 5/00 415/66
7,548,421 B2 * 6/2009 Malone ..... H05K 7/20145 361/695

(Continued)

FOREIGN PATENT DOCUMENTS

CN 201027702 Y 2/2008

*Primary Examiner* — Christopher Verdier
*Assistant Examiner* — Jason A Fountain
(74) *Attorney, Agent, or Firm* — Muncy, Geissler, Olds & Lowe, P.C.

(57) ABSTRACT

A fan includes an impeller, a drive device, and a frame structure. The driving device drives the impeller to rotate, and the frame structure accommodates the driving device. The frame structure includes a frame body, a first frame, a second frame, a base and a plurality of supports. The frame body has first engaging portions and second engaging portions, which are disposed annularly at the upper end and the lower end of the frame body, respectively. The first frame is mounted on the frame body and disposed corresponding to the first engaging portions. The second frame is mounted on the frame body and disposed corresponding to the second engaging portions. The base is disposed within the frame body and located adjacent to the second frame. The supports are disposed around the base. The material of the frame body is different from that of the first and second frames.

18 Claims, 7 Drawing Sheets

(51) Int. Cl.

| | |
|---|---|
| ***F04D 25/08*** | (2006.01) |
| ***F04D 29/32*** | (2006.01) |
| ***F04D 29/54*** | (2006.01) |

(56) References Cited

U.S. PATENT DOCUMENTS

| | | | | |
|---|---|---|---|---|
| 8,113,793 | B2 * | 2/2012 | Yu | F04D 29/053 310/156.11 |
| 9,429,163 | B2 * | 8/2016 | Liu | F04D 29/646 |
| 9,565,785 | B2 * | 2/2017 | Tsai | H05K 7/20172 |
| 2004/0101406 | A1 * | 5/2004 | Hoover | F01D 5/00 416/140 |
| 2014/0241875 | A1 * | 8/2014 | Tsai | H05K 7/20172 415/213.1 |
| 2015/0125262 | A1 * | 5/2015 | Liu | F04D 29/646 415/68 |

* cited by examiner

FAN AND FRAME STRUCTURE THEREOF

CROSS REFERENCE TO RELATED APPLICATIONS

The non-provisional patent application claims priority to U.S. provisional patent application with Ser. No. 62/379,415 filed on Aug. 25, 2016. This and all other extrinsic materials discussed herein are incorporated by reference in their entirety.

This Non-provisional application claims priority under 35 U.S.C. § 119(a) on Patent Application No(s). 201710585556.5 filed in People's Republic of China on Jul. 18, 2017, the entire contents of which are hereby incorporated by reference.

BACKGROUND OF THE DISCLOSURE

Field of Disclosure

The present disclosure relates to a fan and a frame structure, which is made of different materials.

Related Art

In general, the electronic devices and products are usually configured with a fan for directly or indirectly dissipating the generated heat. The high-speed fan is commonly used for achieving a better heat dissipation efficiency, but it also has a higher vibration frequency. The fan will generate a vibration during the high-speed rotation, and the vibration can be transferred to the neighboring devices to generate noise, damage the neighboring devices, and reduce the lifetime of the electronic devices and products.

Accordingly, the frame structure of the fan is properly designed to reduce or absorb the vibration. For example, the frame structure may have a buffer unit disposed between the fan and the base for reducing or absorbing the vibration. As shown in FIG. 1, the conventional fan F0 has a frame structure 7, which is made of a single plastic material. Accordingly, the frame body 71, the first and frames 72, 73 of the frame structure 7 are formed as one piece and have the same resonance zone. When the impeller 8 of the fan F0 rotates in high speed, the vibration response of the frame structure 7 will be focused and magnified, and the function of the buffer unit will be reduced. Therefore, it is desired to provide a frame structure that can improve the resonance zone and decrease the vibration response as the fan is operating.

SUMMARY OF THE DISCLOSURE

The present disclosure provides a fan and a frame structure thereof, which is made of different materials, for dispersing the resonance zone of the frame structure and decreasing the vibration response, thereby optimizing the vibration performance of the fan and achieving the effective vibration absorption of the fan.

To achieve the above, the present disclosure provides a frame structure, which includes a frame body, a first frame, a second frame, a base, and a plurality of supports. The frame body has a plurality of first engaging portions and a plurality of second engaging portions. The first engaging portions are disposed annularly at an upper end of the frame body, and the second engaging portions are disposed annularly at a lower end of the frame body. The first frame is mounted on the upper end of the frame body and disposed corresponding to the first engaging portions. A part of the first frame is embedded in the first engaging portions. The second frame is mounted on the lower end of the frame body and disposed corresponding to the second engaging portions. The base is disposed within the frame body and located adjacent to the second frame. The supports are disposed around a periphery of the base, and two ends of each support are connected to the base and an inner wall of the frame body, respectively. The material of the frame body is different from that of the first and second frames.

In one embodiment, the frame body is made of metal or alloy, and the first and second frames, the base and the supports are made of plastics, rubbers or any of their combinations.

In one embodiment, the second frame, the base and the supports are integrated as a single piece, and the single piece is embedded in the second engaging portions and fixed to the frame body.

In one embodiment, the support is a static blade or a rib.

In one embodiment, the frame body further includes a plurality of third engaging portions. The third engaging portions are annularly disposed at the lower end of the frame body and located adjacent to a tail portion of the frame structure. The second engaging portions are located between the first and third engaging portions.

In one embodiment, the base and the supports are integrated as a single piece, and the single piece is embedded in the second engaging portions and fixed to the inner wall of the frame body. The second frame is embedded in the third engaging portions and fixed to the frame body.

In one embodiment, each of the first, second and third engaging portions is an opening structure, a recess structure, or a protrusion structure.

In one embodiment, a shape of the opening structure is a circle, a wing-shaped, a rectangle, an arc, a curve, or an irregular shape.

In one embodiment, a top surface of the base is configured with an opening, and the opening is connected to a metal bushing.

In addition, the present disclosure also provides a fan, which includes an impeller, a drive device and a frame structure. The drive device drives the impeller to rotate, and the frame structure accommodates the driving device. The frame structure includes a frame body, a first frame, a second frame, a base, and a plurality of supports. The frame body has a plurality of first engaging portions and a plurality of second engaging portions. The first engaging portions are disposed annularly at an upper end of the frame body, and the second engaging portions are disposed annularly at a lower end of the frame body. The first frame is mounted on the upper end of the frame body and disposed corresponding to the first engaging portions. A part of the first frame is embedded in the first engaging portions. The second frame is mounted on the lower end of the frame body and disposed corresponding to the second engaging portions. The base is disposed within the frame body and located adjacent to the second frame. The supports are disposed around a periphery of the base, and two ends of each support are connected to the base and an inner wall of the frame body, respectively. The material of the frame body is different from that of the first and second frames.

In one embodiment, the frame body is made of metal or alloy, and the first and second frames, the base and the supports are made of plastics, rubbers or any of their combinations.

In one embodiment, the second frame, the base and the supports are integrated as a single piece, and the single piece is embedded in the second engaging portions and fixed to the frame body.

In one embodiment, the support is a static blade or a rib.

In one embodiment, the frame body further includes a plurality of third engaging portions. The third engaging portions are annularly disposed at the lower end of the frame body and located adjacent to a tail portion of the frame structure. The second engaging portions are located between the first and third engaging portions.

In one embodiment, the base and the supports are integrated as a single piece, and the single piece is embedded in the second engaging portions and fixed to the inner wall of the frame body. The second frame is embedded in the third engaging portions and fixed to the frame body.

In one embodiment, each of the first, second and third engaging portions is an opening structure, a recess structure, or a protrusion structure.

In one embodiment, a shape of the opening structure is a circle, a wing-shaped, a rectangle, an arc, a curve, or an irregular shape.

In one embodiment, a top surface of the base is configured with an opening, and the opening is connected to a metal bushing.

As mentioned above, the frame structure of a fan has a frame body made of metal with higher resonance frequency, and the resonance zone of the frame structure can be effectively dispersed while utilizing the frame body as the bridge between the first and second frames. In addition, the base and the metal bushing are made of different materials so that the direct transmission of the vibration source as the fan is rotating can be blocked, thereby decreasing the energy transmission from the vibration source and thus achieving the effective vibration absorption of the fan.

BRIEF DESCRIPTION OF THE DRAWINGS

The present disclosure will become more fully understood from the subsequent detailed description and accompanying drawings, which are given by way of illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

Figure 1:
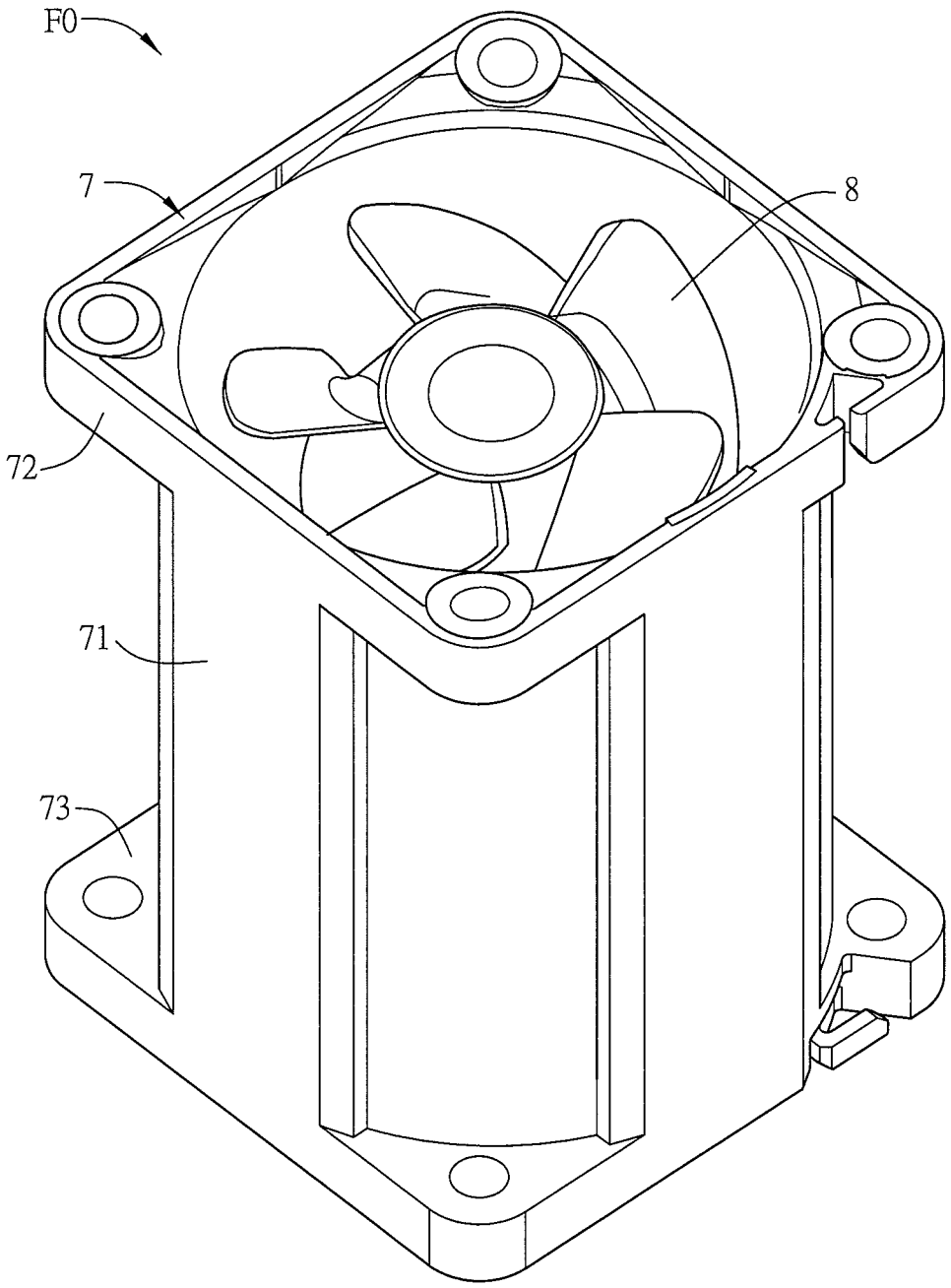
PRIOR ART FIG. 1
FIG. 1 is a schematic diagram of a conventional fan.
Figure 2A:
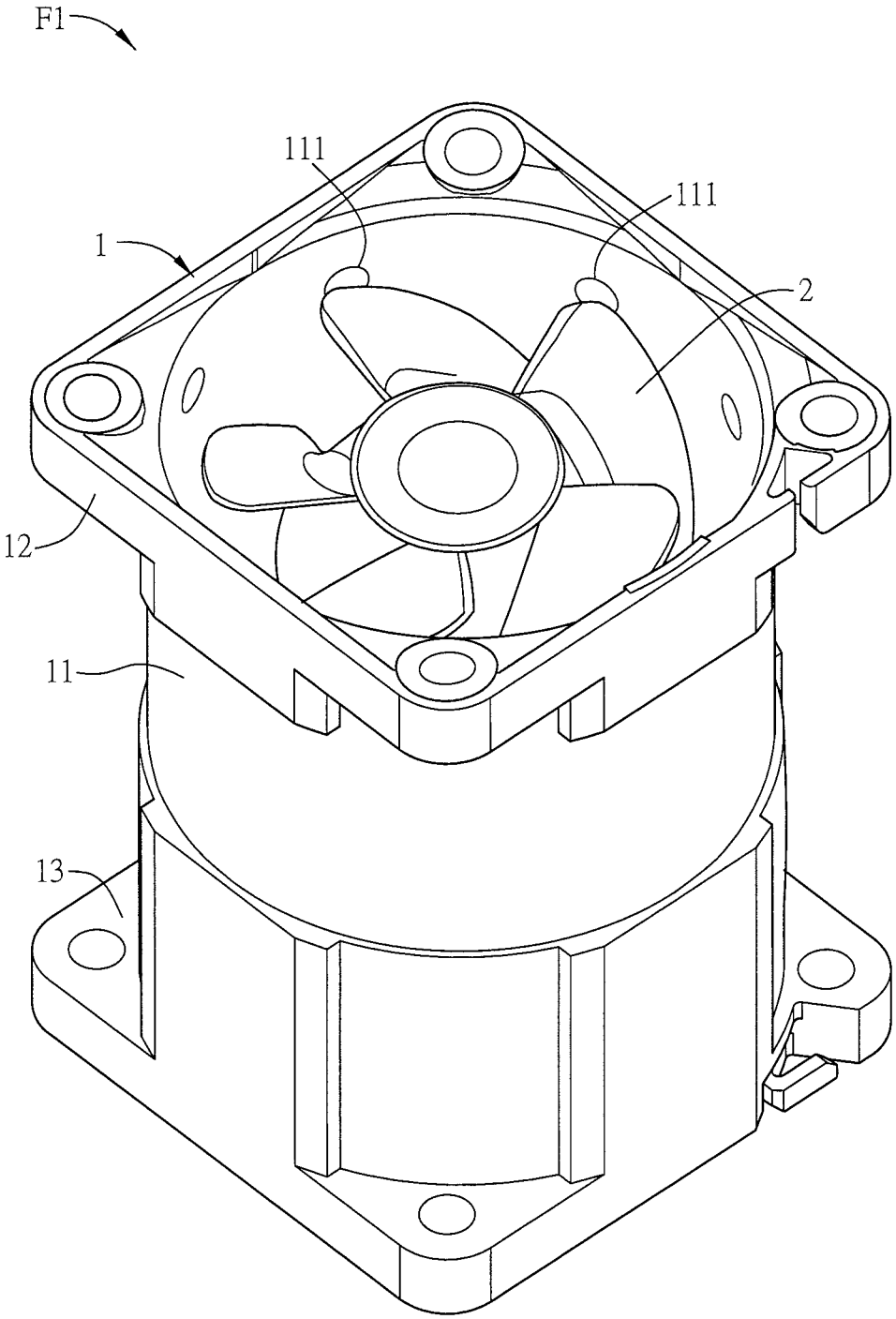
FIG. 2A is a schematic diagram of a fan according to an embodiment of the disclosure.
Figure 2B:
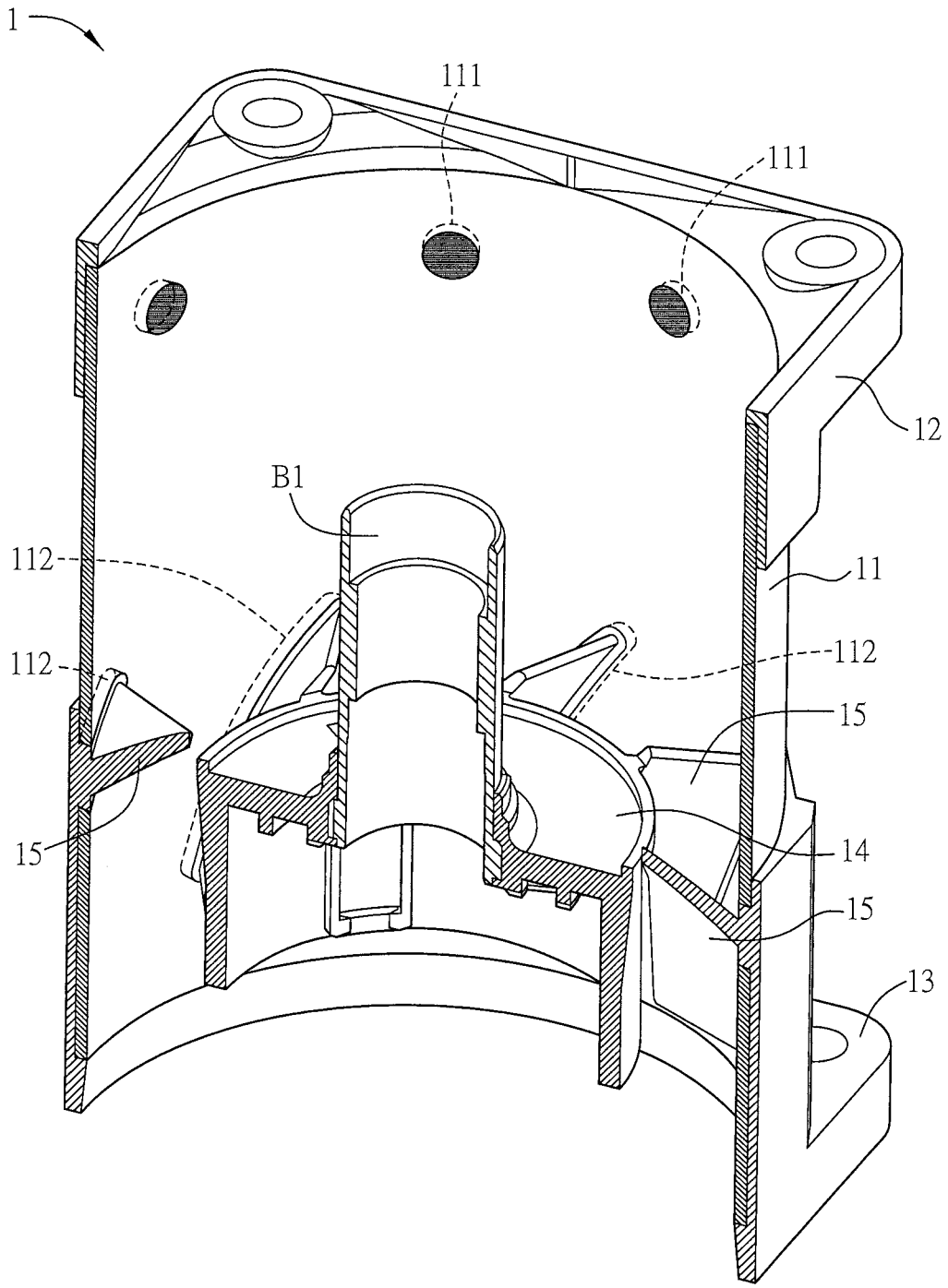
FIG. 2B is a sectional view of the frame structure of FIG. 2A.
Figure 2C:
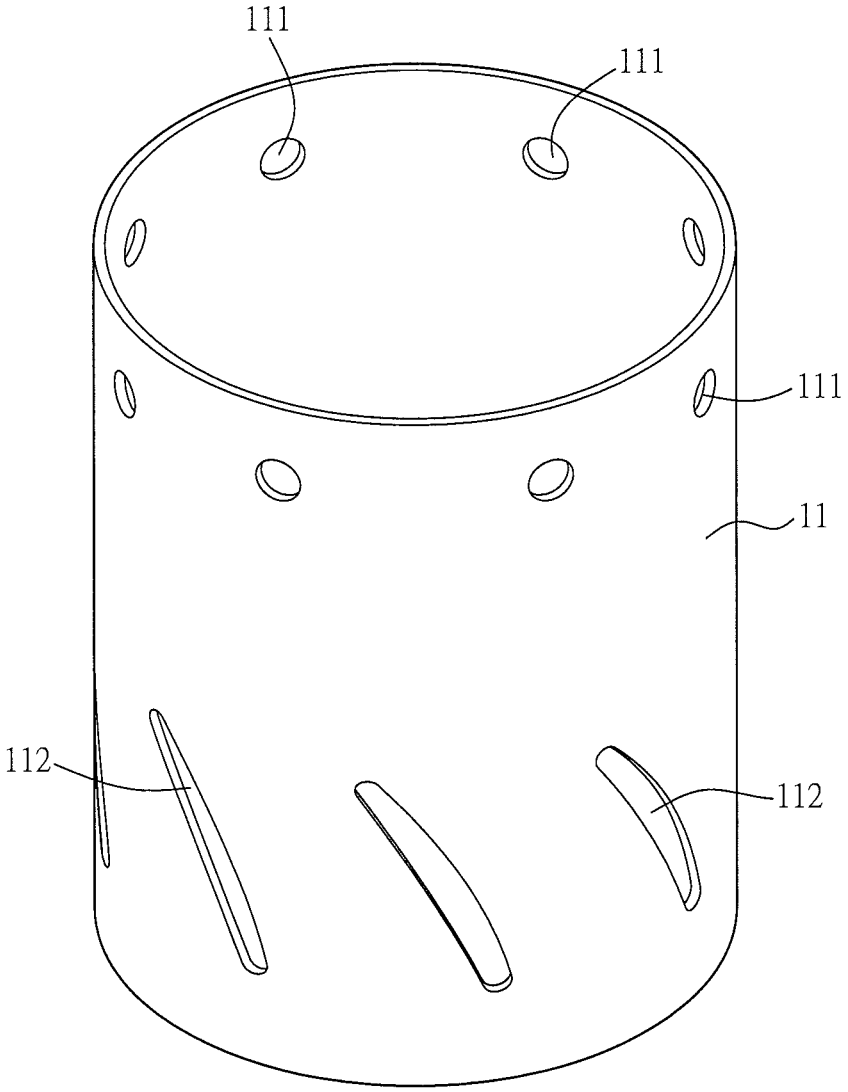
FIG. 2C is a schematic diagram of the frame body of FIG. 2A.

FIG. 2A is a schematic diagram of a fan according to an embodiment of the disclosure, FIG. 2B is a sectional view of the frame structure of FIG. 2A, and FIG. 2C is a schematic diagram of the frame body of FIG. 2A.

The frame structure 1 of this disclosure includes a frame body 11, a first frame 12, a second frame 13, a base 14, and a plurality of supports 15. The frame body 11 has a plurality of first engaging portions 111 and a plurality of second engaging portions 112. The first engaging portions 111 are disposed annularly at an upper end of the frame body 11, and the second engaging portions 112 are disposed annularly at a lower end of the frame body 11. The first frame 12 is mounted on the upper end of the frame body 11 and disposed corresponding to the first engaging portions 111. A part of the first frame 12 is embedded in the first engaging portions 111. The second frame 13 is mounted on the lower end of the frame body 11 and disposed corresponding to the second engaging portions 112. The base 14 is disposed within the frame body 11 and located adjacent to the second frame 13. The supports 15 are disposed around a periphery of the base 14, and two ends of each support 15 are connected to the base 14 and an inner wall of the frame body 11, respectively. The material of the frame body 11 is different from that of the first and second frames 12, 13. Herein, the frame body 11 is made of metal or alloy, and the first and second frames 12, 13, the base 14 and the supports 15 are made of plastics, rubbers or any of their combinations.

In addition, the disclosure also provides a fan F1, which includes an impeller 2, a drive device (not shown), and a frame structure 1. The drive device drives the impeller 2 to rotate, and the frame structure 1 accommodates the driving device. The frame structure 1 includes a frame body 11, a first frame 12, a second frame 13, a base 14, and a plurality of supports 15. The frame body 11 has a plurality of first and second engaging portions 111, 112. The first engaging portions 111 are disposed annularly at an upper end of the frame body 11, and the second engaging portions 112 are disposed annularly at a lower end of the frame body 11. The first frame 12 is mounted on the upper end of the frame body 11 and disposed corresponding to the first engaging portions 111. A part of the first frame 12 is embedded in the first engaging portions 111. The second frame 13 is mounted on the lower end of the frame body 11 and disposed corresponding to the second engaging portions 112. The base 14 is disposed within the frame body 11 and located adjacent to the second frame 13. The supports 15 are disposed around a periphery of the base 14, and two ends of each support 15 are connected to the base 14 and an inner wall of the frame body 11, respectively. The material of the frame body 11 is different from that of the first and second frames 12, 13. Herein, the frame body 11 is made of metal or alloy, and the first and second frames 12, 13, the base 14 and the supports 15 are made of plastics, rubbers or any of their combinations.

In the fan F1 and the frame structure 1 of this disclosure, the frame body 11 is made of metal or alloy, which has higher resonance frequency, and the frame body 11 is located between the first and second frames 12, 13, which are made of plastics or rubbers. Since the frame structure 1 is forming with the combination of different materials, the resonance zone of the frame structure 1 can be effectively dispersed, thereby decreasing the energy transmission from the vibration source and thus achieving the effective vibration absorption of the fan F1.

Referring to FIGS. 2A, 2B and 2C, the first and second engaging portions 111, 112 of the frame body 11 can be individually, for example but not limited to, the opening structure as shown in FIG. 2C. Besides, the first and second engaging portions 111, 112 of the frame body 11 can also be designed as a recess structure or a protrusion structure based on the design requirement of the frame structure 1. As shown in FIG. 2C, the first and second engaging portions 111, 112 are opening structures, and the shape of the opening structure can be a circle, a wing-shaped, a rectangle, an arc, a curve, or an irregular shape. According to the design requirement of the frame structure 1, the first and second engaging portions can be different aspects. In these aspects, the first and second engaging portions may have the same or different shapes, and the individual of the first and second engaging portions may have the same or different shapes.

As mentioned above, a part of the first frame 12 of the frame structure 1 is embedded in the first engaging portions 111 so that the first frame 12 can be fixed to and mounted on the upper end of the frame body 11. Similarly, a part of the second frame 13 is embedded in the second engaging portions 112 so that the second frame 13 can be fixed to and mounted on the lower end of the frame body 11. The configuration of the first and second engaging portions 111, 112 can firmly fix the first and second frames 12, 13 at the ends of the frame body 11.

In this embodiment, the frame body 11 is made of injection molding. In practice, the frame body 11, which is made of metal material, is placed in a mold, and then the plastic raw material is heated and injected to the mold so as to form the plastic or rubber first frame 12, which is embedded in the first engaging portions 111 and mounted on the upper end of the frame body 11. Similarly, the plastic raw material is heated and injected to the mold so as to form the plastic or rubber second frame 13, which is embedded in the second engaging portions 112 and mounted on the lower end of the frame body 11. Furthermore, the second frame 13, the base 14 and the supports 15 can be integrated as a single piece by the injection molding. This single piece is embedded in the second engaging portions 112 and fixed to the frame body 11. In this embodiment, the support 15 is a static blade or a rib.

Figure 3A:
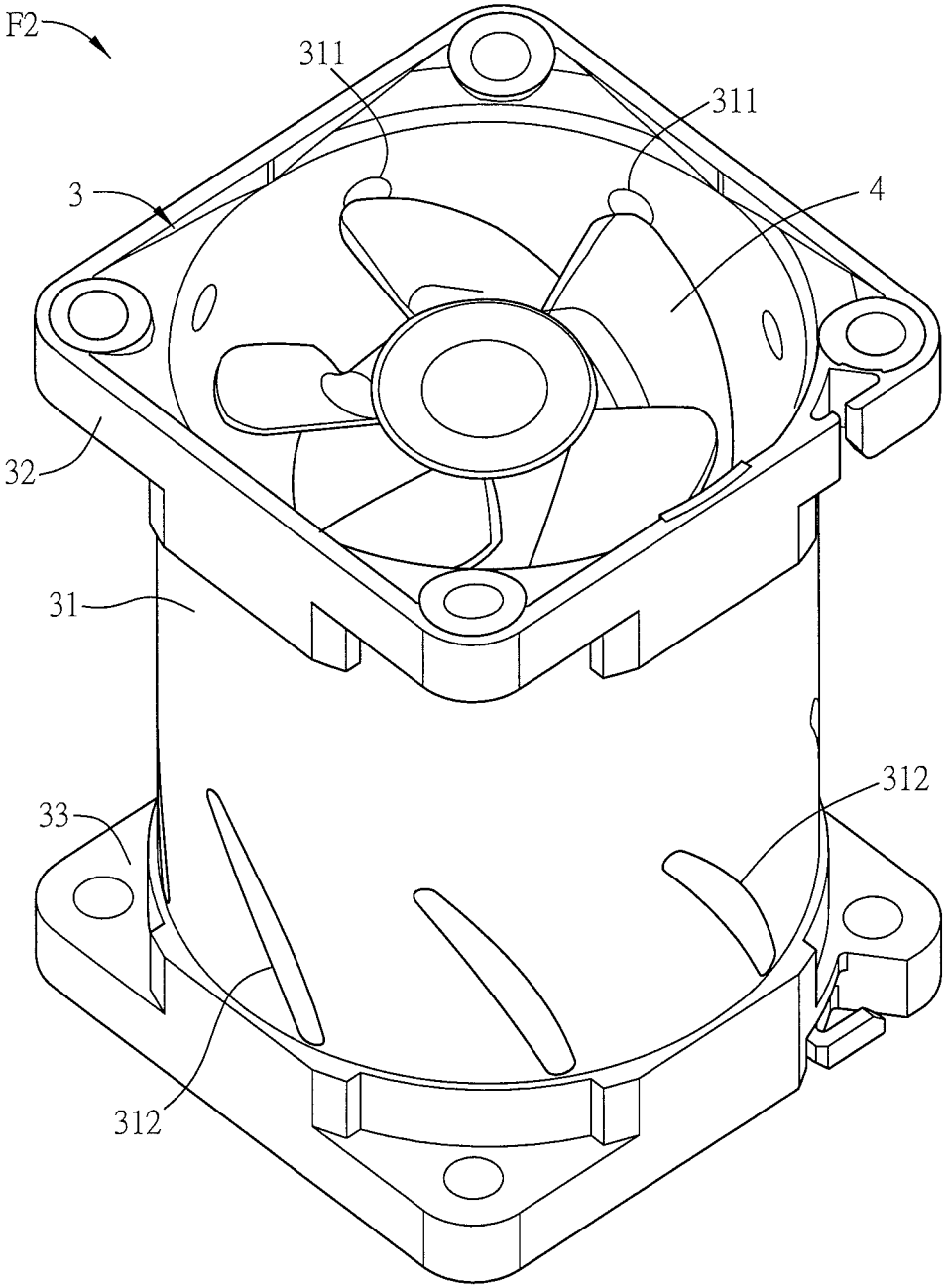
FIG. 3A is a schematic diagram of a fan according to another embodiment of the disclosure.
Figure 3B:
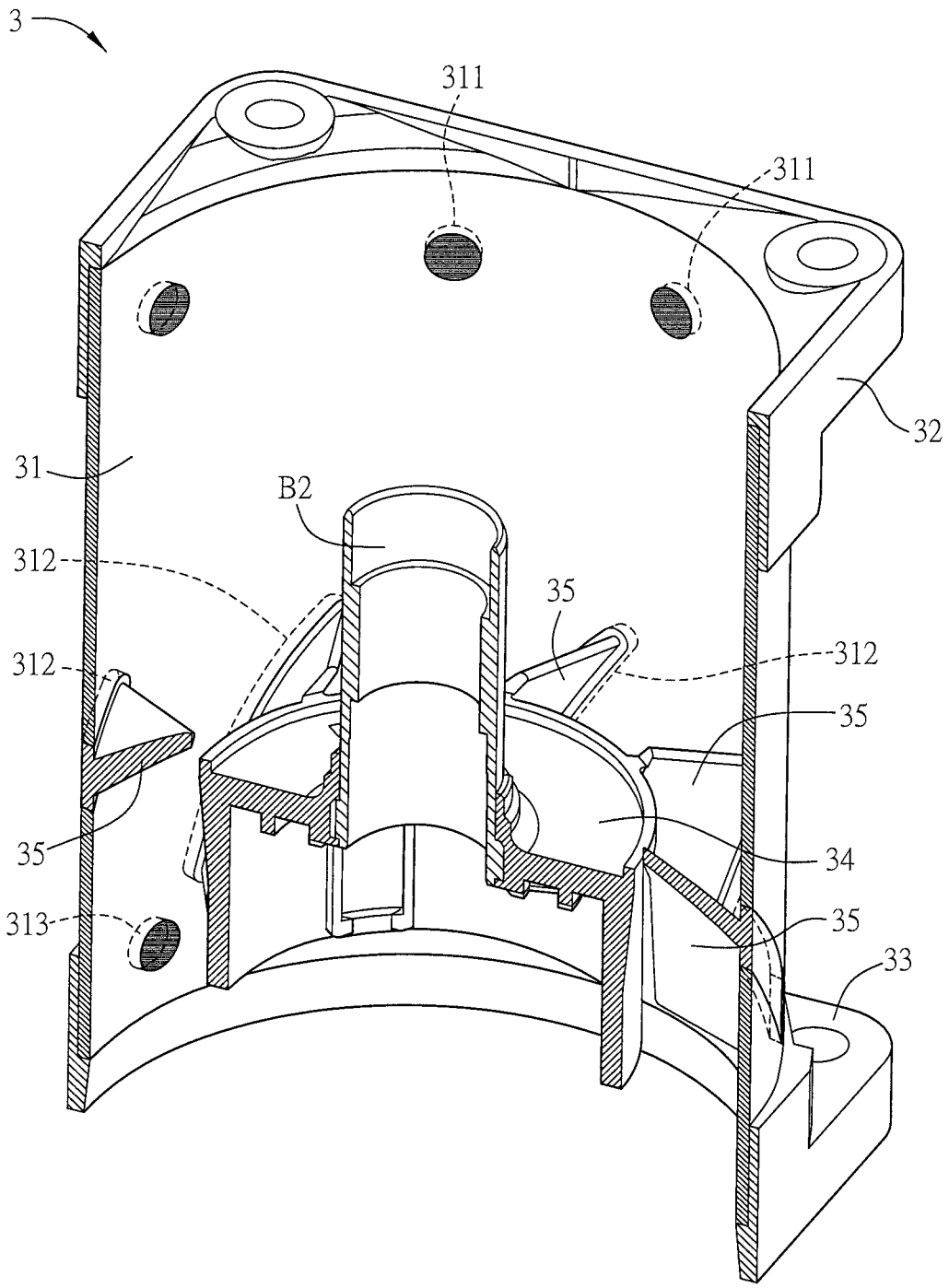
FIG. 3B is a sectional view of the frame structure of FIG. 3A.
Figure 3C:
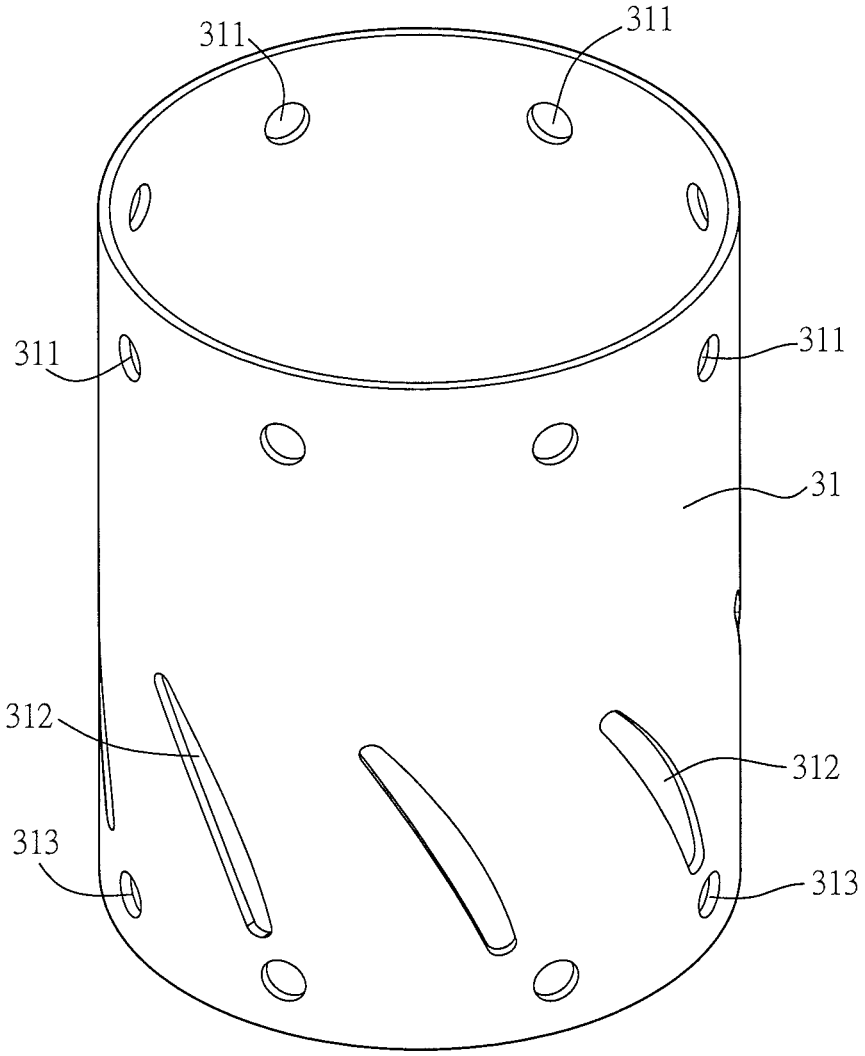
FIG. 3C is a schematic diagram of the frame body of FIG. 3A.

Referring to FIGS. 3A, 3B and 3C, the frame body 31 of the fan F2 further includes a plurality of third engaging portions 313, which are annularly disposed at the lower end of the frame body 31 and located adjacent to a tail portion of the frame structure 3. The second engaging portions 312 are located between the first and third engaging portions 311, 313. In this case, the opening structure of the third engaging portion 313 is a circle, and this disclosure is not limited thereto. In this embodiment, the first, second and third engaging portions 311, 312, 313 may all have the same shape, one of them has a different shape, or all of them have different shapes. The third engaging portions 313 may individually have the same or different shapes.

Similarly, the frame body 31 can also be made of injection molding. In practice, the frame body 31, which is made of metal material, is placed in a mold, and then the plastic raw material is heated and injected to the mold so as to form the plastic or rubber first frame 32, which is embedded in the first engaging portions 311 and mounted on the upper end of the frame body 31. Similarly, the plastic or rubber second frame 33 is embedded in the third engaging portions 313 and mounted on the lower end of the frame body 31. Furthermore, the base 34 and the supports 35 can be integrated as a single piece by the injection molding. This single piece is embedded in the second engaging portions 312 and fixed to the inner wall of the frame body 31.

With reference to FIGS. 2A, 2B, 3A and 3B, the top surface of the base 14 or 34 is configured with an opening (not shown), which is connected to a metal bushing B1 or B2. Since the metal bushing B1 or B2 and the plastic or rubber base 14, 34 are a combination of different materials, the direct transmission from the vibration source can be blocked as the impeller 2 or 4 and the drive device (not shown) of the fan F1 or F2 are in operation, thereby decreasing the energy transmission from the vibration source.

In summary, the frame structure of a fan of the disclosure has a frame body made of metal or alloy material with higher resonance frequency, and the frame body is disposed between the first frame and the second frame, which are made of plastics or rubbers. Since the frame structure is formed with the combination of different materials, the resonance zone of the frame structure can be effectively dispersed, thereby decreasing the energy transmission from the vibration source and thus achieving the effective vibration absorption of the fan. Moreover, since the metal bushing and the base are a combination of different materials, the direct transmission from the vibration source can be blocked as the fan is in operation, thereby achieving the effective vibration absorption of the fan.

Although the present disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present disclosure.

What is claimed is:

1. A frame structure, comprising:

a frame body having a plurality of first engaging portions and a plurality of second engaging portions, wherein the first engaging portions are disposed annularly at an upper end of the frame body, and the second engaging portions are disposed annularly at a lower end of the frame body;

a first frame mounted on the upper end of the frame body and disposed corresponding to the first engaging portions, wherein a part of the first frame is embedded in the first engaging portions;

a second frame mounted on the lower end of the frame body and disposed corresponding to the second engaging portions;

a base disposed within the frame body and located adjacent to the second frame; and a plurality of supports disposed around a periphery of the base, wherein two ends of each of the supports are connected to the base and an inner wall of the frame body, respectively;

wherein a material of the frame body is different from that of the first and second frames, the frame body further comprises a plurality of third engaging portions, the third engaging portions are annularly disposed at the lower end of the frame body and located adjacent to a tail portion of the frame structure, and the second engaging portions are located between the first and third engaging portions.

2. The frame structure of claim 1, wherein the frame body is made of metal or alloy, and the first and second frames, the base and the supports are made of plastics, rubbers or any of their combinations.

3. The frame structure of claim 1, wherein the second frame, the base and the supports are integrated as a single piece, and the single piece is embedded in the second engaging portions and fixed to the frame body.

4. The frame structure of claim 1, wherein the support is a static blade or a rib.

5. The frame structure of claim 1, wherein the base and the supports are integrated as a single piece, the single piece is embedded in the second engaging portions and fixed to the inner wall of the frame body, and the second frame is embedded in the third engaging portions and fixed to the frame body.

6. The frame structure of claim 1, wherein each of the first, second and third engaging portions is an opening structure, a recess structure, or a protrusion structure.

7. The frame structure of claim 6, wherein a shape of the opening structure is a circle, a wing-shaped, a rectangle, an arc, a curve, or an irregular shape.

8. The frame structure of claim 1, wherein a top surface of the base is configured with an opening, and the opening is connected to a metal bushing.

9. A fan, comprising:

an impeller; and a frame structure accommodating the impeller and comprising:

a frame body having a plurality of first engaging portions and a plurality of second engaging portions, wherein the first engaging portions are disposed annularly at an upper end of the frame body, and the second engaging portions are disposed annularly at a lower end of the frame body;

a first frame mounted on the upper end of the frame body and disposed corresponding to the first engaging portions, wherein a part of the first frame is embedded in the first engaging portions;

a second frame mounted on the lower end of the frame body and disposed corresponding to the second engaging portions;

a base disposed within the frame body and located adjacent to the second frame; and a plurality of supports disposed around a periphery of the base, wherein two ends of each of the supports are connected to the base and an inner wall of the frame body, respectively;

wherein a material of the frame body is different from that of the first and second frames, the frame body further comprises a plurality of third engaging portions, the third engaging portions are annularly disposed at the lower end of the frame body and located adjacent to a tail portion of the frame structure, and the second engaging portions are located between the first and third engaging portions.

10. The fan of claim 9, wherein the frame body is made of metal or alloy, and the first frame, the second frame, the base and the supports are made of plastics, rubbers or any of their combinations.

11. The fan of claim 9, wherein the second frame, the base and the supports are integrated as a single piece, and the single piece is embedded in the second engaging portions and fixed to the frame body.

12. The fan of claim 9, wherein the support is a static blade or a rib.

13. The fan of claim 9, wherein the base and the supports are integrated as a single piece, the single piece is embedded in the second engaging portions and fixed to the inner wall of the frame body, and the second frame is embedded in the third engaging portions and fixed to the frame body.

14. The fan of claim 9, wherein each of the first, second and third engaging portions is an opening structure, a recess structure, or a protrusion structure.

15. The fan of claim 14, wherein a shape of the opening structure is a circle, a wing-shaped, a rectangle, an arc, a curve, or an irregular shape.

16. The fan of claim 9, wherein a top surface of the base is configured with an opening, and the opening is connected to a metal bushing.

17. A frame structure, comprising:

a frame body having a plurality of first engaging portions and a plurality of second engaging portions, wherein the first engaging portions are disposed annularly at an upper end of the frame body, and the second engaging portions are disposed annularly at a lower end of the frame body;

a first frame mounted on the upper end of the frame body and disposed corresponding to the first engaging portions, wherein a part of the first frame is embedded in the first engaging portions;

a second frame mounted on the lower end of the frame body and disposed corresponding to the second engaging portions;

a base disposed within the frame body and located adjacent to the second frame; and a plurality of supports disposed around a periphery of the base, wherein two ends of each of the supports are connected to the base and an inner wall of the frame body, respectively;

wherein a material of the frame body is different from that of the first and second frames;

wherein the second frame, the base and the supports are integrated as a single piece, and the single piece is embedded in the second engaging portions and fixed to the frame body.

18. A fan, comprising:

an impeller; and a frame structure accommodating the impeller and comprising:

a frame body having a plurality of first engaging portions and a plurality of second engaging portions, wherein the first engaging portions are disposed annularly at an upper end of the frame body, and the second engaging portions are disposed annularly at a lower end of the frame body;

a first frame mounted on the upper end of the frame body and disposed corresponding to the first engaging portions, wherein a part of the first frame is embedded in the first engaging portions;

a second frame mounted on the lower end of the frame body and disposed corresponding to the second engaging portions;

a base disposed within the frame body and located adjacent to the second frame; and a plurality of supports disposed around a periphery of the base, wherein two ends of each of the supports are connected to the base and an inner wall of the frame body, respectively;

wherein a material of the frame body is different from that of the first and second frames;

wherein the second frame, the base and the supports are integrated as a single piece, and the single piece is embedded in the second engaging portions and fixed to the frame body.

* * * * *